US007407473B2

(12) United States Patent
Saviano

(10) Patent No.: US 7,407,473 B2
(45) Date of Patent: Aug. 5, 2008

(54) CENTRIFUGE SLEEP MODE CONTROL

(75) Inventor: Vincent Saviano, Sandy Hook, CT (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 0 days.

(21) Appl. No.: 10/409,074

(22) Filed: Apr. 9, 2003

(65) Prior Publication Data

US 2003/0199378 A1 Oct. 23, 2003

Related U.S. Application Data

(60) Provisional application No. 60/373,620, filed on Apr. 19, 2002.

(51) Int. Cl.
*B04B 15/02* (2006.01)

(52) U.S. Cl. ..... 494/11; 62/228.1; 62/231; 165/200; 210/138; 210/512.1; 210/787; 494/14; 494/37

(58) Field of Classification Search ..... 494/1, 494/7, 10, 11, 14, 37; 700/273; 422/72; 436/45, 177; 210/143, 149, 512.1, 739, 787, 210/138; 604/4.01; 62/132, 133, 228.1, 62/231; 345/173; 165/200
See application file for complete search history.

(56) References Cited

U.S. PATENT DOCUMENTS

| | | | | |
|---|---|---|---|---|
| 3,246,688 | A * | 4/1966 | Colhurn | 165/288 |
| 3,877,243 | A * | 4/1975 | Kramer | 62/180 |
| 4,269,042 | A * | 5/1981 | Williams | 62/513 |
| 5,024,415 | A * | 6/1991 | Purens | 248/349.1 |
| 5,261,252 | A * | 11/1993 | Peruch | 494/14 |
| 5,721,676 | A * | 2/1998 | Bolden et al. | 700/3 |
| 5,964,724 | A * | 10/1999 | Rivera et al. | 604/5.04 |
| 6,378,319 | B1 * | 4/2002 | Mani | 62/239 |
| 6,621,507 | B1 * | 9/2003 | Shah | 715/764 |
| 6,622,052 | B1 * | 9/2003 | Rosiello | 700/11 |
| 6,622,505 | B2 * | 9/2003 | Anderson et al. | 62/228.3 |

FOREIGN PATENT DOCUMENTS

GB 2101514 * 1/1983

* cited by examiner

*Primary Examiner*—Joseph Drodge
(74) *Attorney, Agent, or Firm*—Baker & Hostetler LLC

(57) ABSTRACT

A method and apparatus is disclosed for setting energy saver sleep modes for use in a centrifuge systems. The centrifuge system contains an energy saver touch screen control which can be either manually set or automatically set to turn the centrifuge on or off at predetermined times. This allows the centrifuge system to be readily available to a user, resulting in lower wear and tear being placed on the major systems of the centrifuge and waste less energy.

17 Claims, 4 Drawing Sheets

CENTRIFUGE SLEEP MODE CONTROL

PRIORITY

This application claims priority to the provisional U.S. patent application entitled, Centrifuge Sleep Mode to Save Energy with Timed Start-Up, filed Apr. 19, 2002, having a serial No. 60/373,620, the disclosure of which is hereby incorporated by reference.

FIELD OF THE INVENTION

The present invention relates generally to centrifuge energy consumption. More particularly, the present invention relates to a centrifuge sleep mode control system and method.

BACKGROUND OF THE INVENTION

A centrifuge instrument is a device by which contained materials of different specific quantities are subjected to centrifugal forces in order to separate colloidal particles suspended in a liquid. A typical centrifuge set-up may include a centrifuge tube which holds a sample for separation. A plurality of centrifuge tubes may be located and retained on a rotor of the centrifuge. The rotor of the centrifuge is commonly configured to be contained in a compartment and spun about a central axis in order to achieve separation of the sample. A rotatable drive shaft may be connected to the centrifuge rotor in order to facilitate spinning of the rotor assembly. The rotatable drive shaft may be further connected to a source of motive energy in order to receive power.

Centrifuges are currently employed in many industrial and research situations, such as, for example, laboratories. Laboratory ecntrifuges are generally operated by manual controls using various settings and procedures. The calibration of the centrifuge is important in order to achieve proper separation of particles within test samples during testing under controlled operating conditions. An operator may want to pre-set various aspects of the testing condition or indicated specific components coupled to the system of the centrifuge. This information could be further conveyed to a processor located within the centrifuge and be utilized for preparing the centrifuge to operate under a prescribed testing condition.

An example of relayed information that can set up a condition of the centrifuge may include a rotor control used to set the specific size or type of rotor used within the centrifuge. This would allow the centrifuge to operate a given rotor assembly at preferred power levels. Different rotors are capable of operating at different speeds and are further capable of generating different centripetal forces. Such control would be preferable in order to operate a given rotor at a peak efficiency and prescribed rotational forces and/or speeds.

Additionally, a temperature control and a timer control may also be set in accordance with a type of sample being tested. It may be important to maintain a certain operating temperature for the test sample over a given period of time. This may also include requirements for a sample to sit at an operation temperature for a prescribed time before and/or after testing within the centrifuge. This temperature would be regulated by the temperature control of the centrifuge. The length of time that the sample would be subjected to specific temperal conditions would be regulated by the time control.

An operator may also want to apply the centripetal force generated by the rotor over a regulated time period. This, of course, would depend on the goals for testing a product and the test sample itself. Additional controls may also include conventional power switches provided on the centrifuge device to manually turn the unit on or off as needed.

Thus, it is clear that the ability to control functions of the centrifuge can be advantageous to a user and the samples being tested. Having a greater flexibility to control the testing environment would yield a greater variety of functions in the testing capabilities provided by the centrifuge. While technological advances have made it easier to calibrate and control operations of the centrifuge, there remain some functions which still require extensive set-up or waste resources during "down-times". For example, if a user desired to have a centrifuge readily available for testing samples at a pre-set temperature, the user would have to leave the centrifuge on during "down-time" in order to avoid any "warm-up" delays. This method of operating the centrifuge can cause undesirable wear and tear on its systems such as the refrigerator compresser or the refrigerator condenser. Additionally, an amount of energy is lost while simply maintaining a condition of the centrifuge without actually using it.

Thus, there is a need in the art for a system and method that would allow a centrifuge to be readily available to a user without the delays involved with "warm-up" times and avoid excessive wear and tear placed upon the internal hardware components of the centrifuge. It would also be desirable to conserve energy during down times.

SUMMARY OF THE INVENTION

The foregoing needs are met, to a great extent, by the present invention. The present invention overcomes the prior art problems, at least to a great extent, by utilizing an energy saver touch screen control, which can be either manually set or automatically set to turn the centrifuge on or off at predetermined times.

It is therefore a feature and advantage of the present invention to provide a separation device that includes a centrifuge having system components and a controller that activates and/or deactivates a sleep mode of the system components. The sleep mode activation and/or deactivation is enabled manually or automatically. The sleep mode may be enabled and/or disabled based upon a specific time and/or date. Additionally, the system components of the centrifuge operate at low power when the sleep mode is enabled. The system components may include at least one of a drive motor, a refrigerator compressor, and a refrigeration condenser. The controller may include a computer system operated by a software protocol. A computer touch screen may be coupled to the computer system in order to implement the software protocol to enable and/or disabled the sleep mode.

In another aspect of the invention, a method of regulating power consumption in a separation device having system components includes regulating the power consumption of the system components by coupling a controller to the system components. The method further includes activating the controller to enable and/or disable a sleep mode of the centrifuge in order to regulate the power consumption of the system components. Activating the controller may include operating a user interface of the controller. The user interface may comprise a computer touch screen. The method may include programming the computer touch screen to permit a software protocol to enable and/or disable the sleep mode of the centrifuge. Such enablement of the sleep mode may be based upon a specific time and/or date.

In another aspect of the invention, a separation system includes providing a centrifuge having system components and a means for controlling activation and/or deactivation of a sleep mode of the system components. The system may further include a means for manually or automatically activating and/or deactivating the sleep mode. The activation and/or deactivation of the sleep mode may be based upon a specific time and/or date. The system also provides a means for interfacing with the means for controlling.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The present invention provides a system and method including an energy saver touch screen control which can be coupled to a centrifuge device. Embodiments of the invention can allow the centrifuge to be readily accessible to a user without delays associated with "warm-up" times and avoid excessive wear and tear upon internal components of the centrifuge. Some embodiments also preserve energy during down times.

Figure 1:
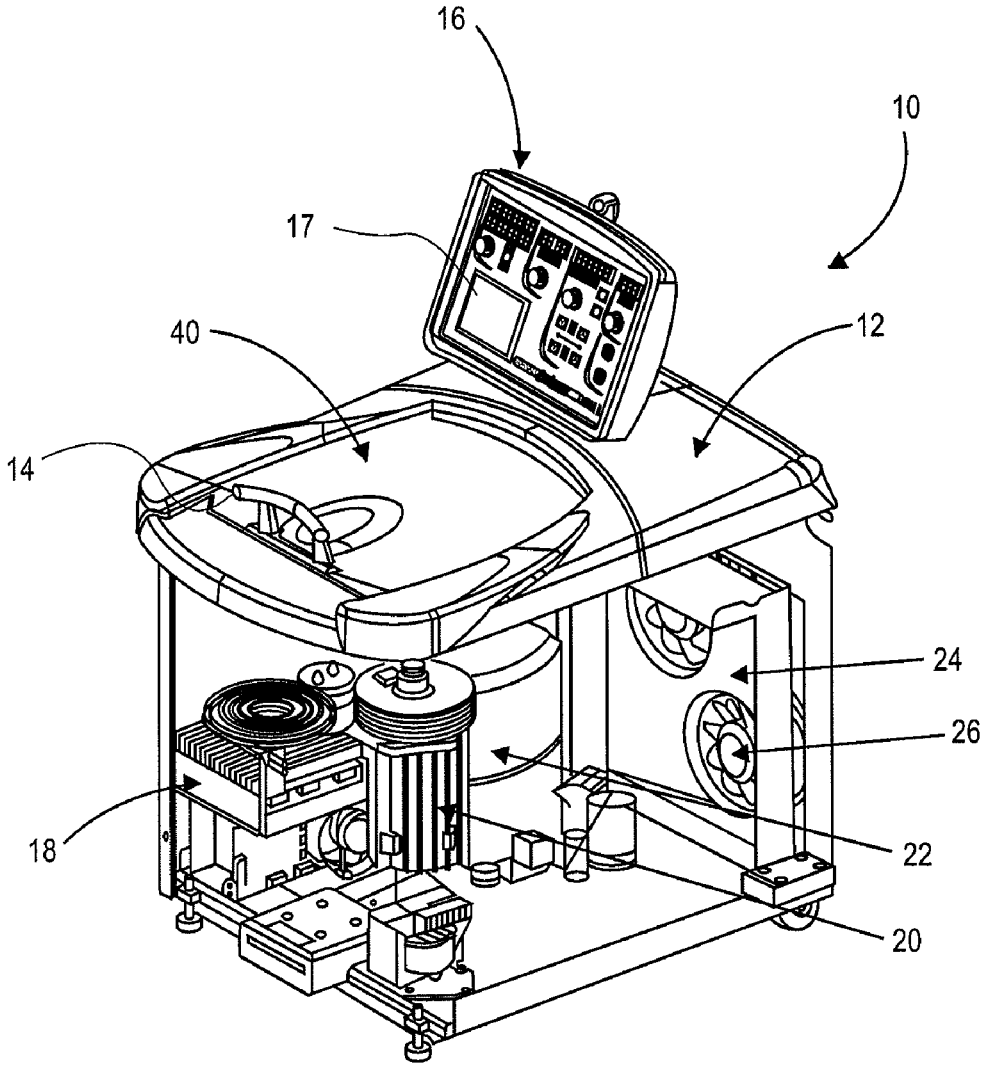
FIG. 1 is a perspective view of a centrifuge in accordance with one preferred embodiment of the invention.

A preferred embodiment of the present invention will now be described with reference to the drawing figures, in which like reference numbers refer to like elements throughout. Referring to FIG. 1, a centrifuge 10 includes a centrifuge housing 12 which encapsulates various hardware systems of the centrifuge 10. Connected to the centrifuge housing 12 is a control console 16. The control console 16 may be tiltably adjustable with respect to the centrifuge housing 12 in order to accommodate various operators in different positions relative to an interface 17 of the control console 16.

Access to the centrifuge chamber may be gained through the door 12. This can be achieved by simply sliding the handle 14 back towards the control console 16. The internal components of the centrifuge 10 may include a variety of hardware components. A major purpose of such components would allow the centrifuge 10 to subject test samples to centrifugal forces. An additional purpose of the centrifuge components may include regulating the operating temperature of test samples. In a drive motor 20 is controlled by drive motor power electronics 18. Additional system components may include a refrigeration compressor 22, a refrigeration condenser 24 and cooling fans 26.

Figure 2:
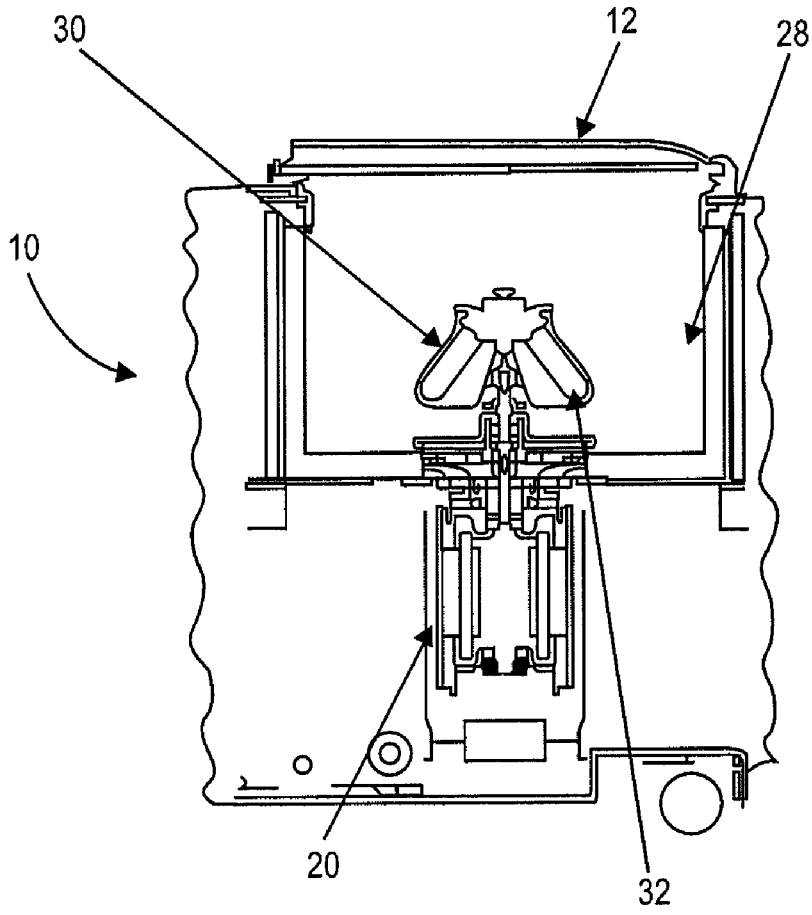
FIG. 2 is an internal layout view of the centrifuge shown in FIG. 1.

FIG. 2 illustrates additional hardware components of the centrifuge 10. A centrifuge chamber 28 contains a centrifuge rotor 30 which is further connected to a drive motor 20. The centrifuge rotor 30 is capable of retaining centrifuge tubes 32. The centrifuge tubes 32 hold test samples to be subjugated to the separation process. In operation, the centrifuge rotor 30 is configured to be contained in the centrifuge chamber 28. The centrifuge tubes 32 (containing test samples) may be spun about a central axis, via centrifuge rotor 30, to achieve separation of the sample.

Figure 3:
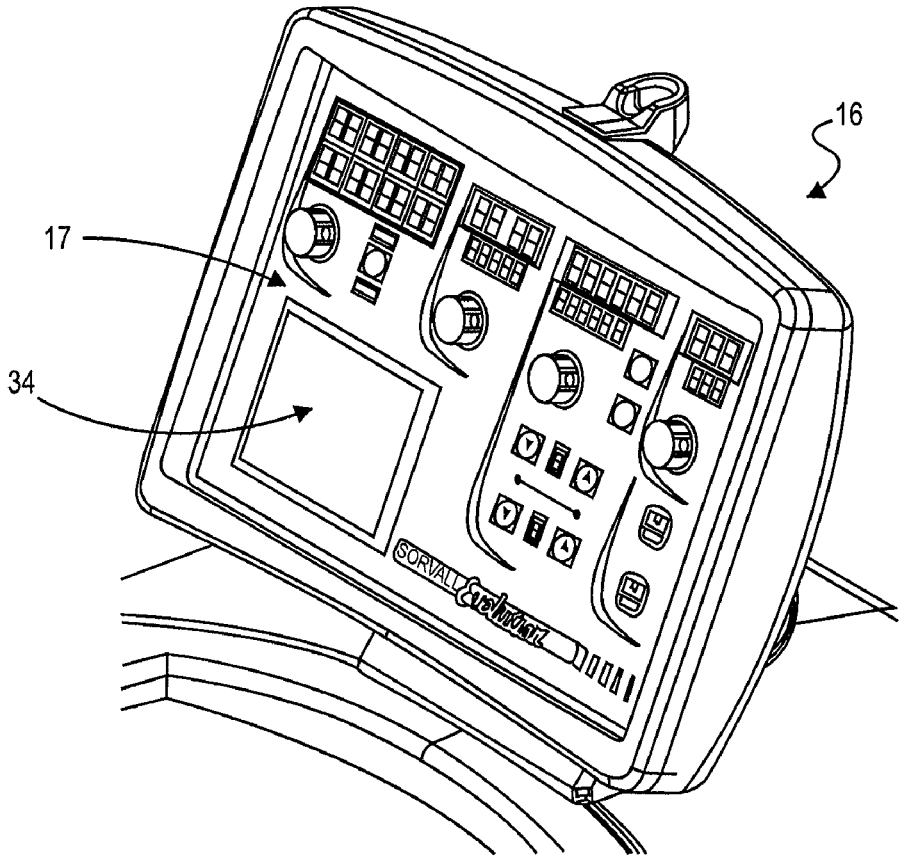
FIG. 3 is a perspective view of the console of the centrifuge in shown FIG. 1.

FIG. 3 provides a closer view of the control console 16 used to calibrate the centrifuge 10. The control console interface 17 of the control console 16 includes various control knobs, switches, and warning indicators. The control knobs and switches can be set to predetermined test parameters by an operator. The predetermined test parameters control how test samples, located within the centrifuge tubes 32, are tested by the centrifuge 10. Examples of test information, which may be set by an operator, include setting the run time of the centrifuge 10. It may also be important to indicate which model rotor is installed in the centrifuge 10. Furthermore, operator may want to set the revolutions per minute (RPM) that the centrifuge rotor 30 achieves during testing of the test sample.

The control console interface 16 of the control console 17 often is also be configured to allow an operator to regulate the temperature of the centrifuge chamber 28 during testing. The control console interface 16 often is also configured to allow an operator to regulate the acceleration and/or deceleration of the rotor during testing.

A touch screen interface 34 often may also be integrated into the control console interface 17. As depicted in FIG. 3, a preferred embodiment of the invention provides a touch screen interface 34 which may be integrated directly on the control console interface 17. The touch screen interface 34 is preferably configured to allow a user the option to disable the power of the centrifuge 10. At the next usage, the user can reapply power by enabling the centrifuge, and wait for the centrifuge to reach an operating temperature.

The present invention allows the centrifuge operator to program a time of day when the centrifuge will enter a sleep mode. The centrifuge sleep mode enables or disables various components of the centrifuge system. This may include, for example, the drive motor 20, the drive motor power electronics 18, the refrigerator compressor 22, the refrigerator condenser 24 and cooling fans 26. The sleep mode reduces power consumption while allowing the system components of the centrifuge to remain energized at a lower energy state. The operator is in control of when the centrifuge will exit sleep mode thereby making all centrifuge systems such as the motor, refrigeration and, compressor re-energize and fully operational again.

Figure 4:
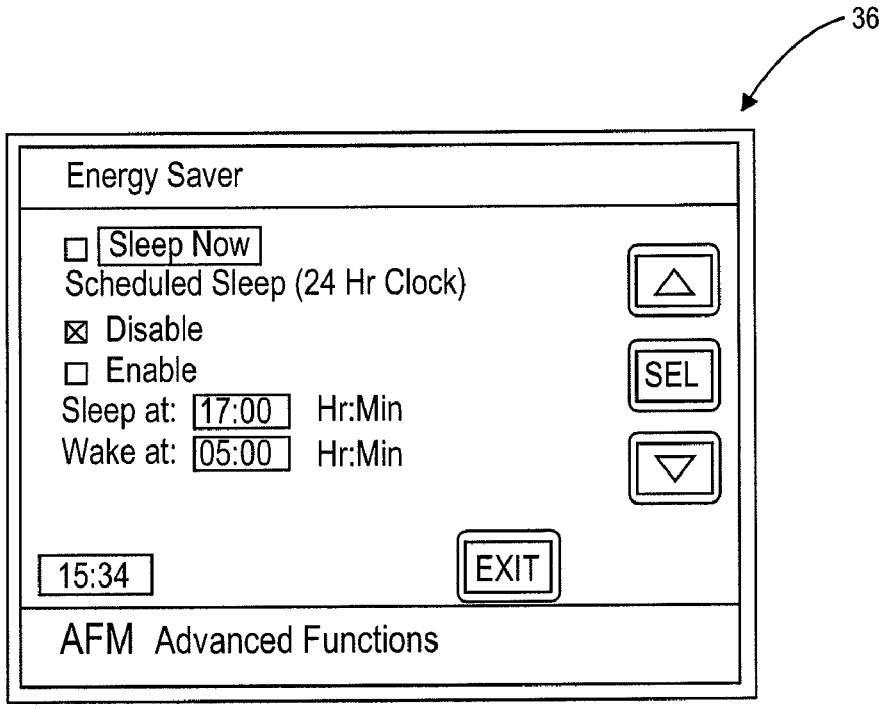
FIG. 4 is a screen interface of one preferred embodiment of the present invention showing the energy saver protocols.

Referring to FIG. 4, the energy saver mode function of the touch screen 36 allows the centrifuge to be placed in a dormant "sleep" condition and operates in one of three ways. First, if "Sleep Now" is selected with "Scheduled Sleep" disabled, the centrifuge will immediately go into sleep mode and will remain sleeping until it is manually awakened. Second, if "Sleep Now" is selected with "Scheduled Sleep" enabled, the centrifuge will immediately go to sleep and will remain sleeping until it either automatically awakens at a specified time of day or until it is manually awakened before the wake time is reached. Third, if "Scheduled Sleep" is enabled and "Sleep Now" has not been selected, the centrifuge will automatically go to sleep at a specified time of day and will remain sleeping until it either automatically awakens at a different specified time of day or until it is manually awakened before the wake time is reached.

Figure 5:
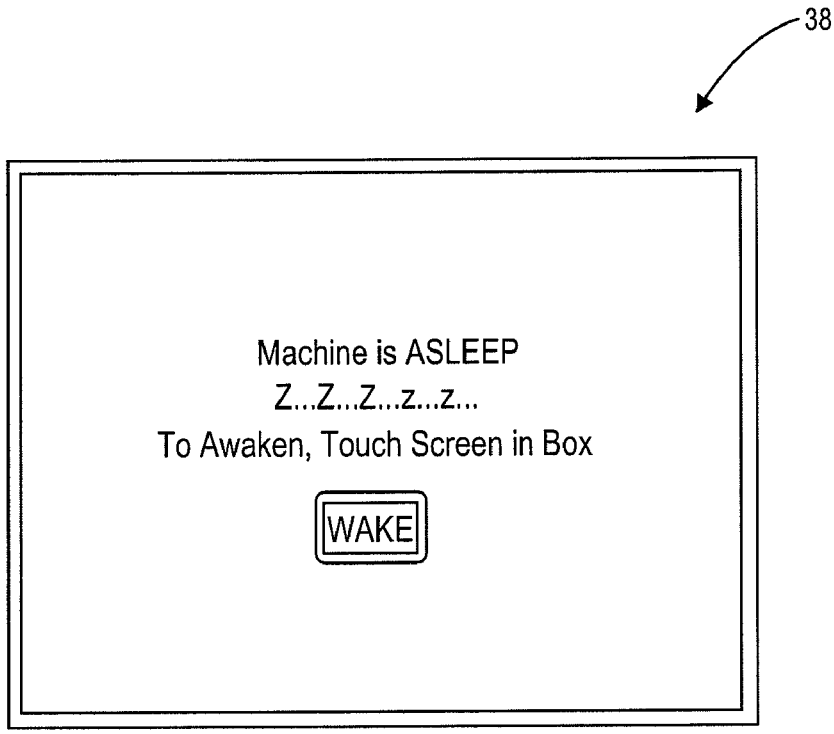
FIG. 5 is a screen interface of one preferred embodiment of the present invention showing that the centrifuge system is asleep.

Referring to FIG. 5, during sleep mode, the touch screen 38 indicates that the centrifuge is in a powered-down state. In a powered-down state, various components of the centrifuge system operate under low power. This may include, for example, the drive motor 20, the drive motor power electronics 18, the refrigerator compressor 22 and the refrigerator condenser 24. In sleep mode, power consumption is reduced while allowing the system components to remain energized at a lower energy state. However, the touch screen interface 34 will remain lit and the cooling fans 26 for the drive module and motor will continue to run. Operation of the cooling fans 26 is important in order to maintain an operating temperature of the test samples. Once in the sleep energy mode, the sleeping centrifuge may be awakened at any time by touching the "Wake" button on the touch screen 38. This operation will restore full power to any system components that were in a reduced or power state in sleep mode.

By utilizing the sleep mode of the centrifuge, the excessive wear and tear on the major systems of the centrifuge are often greatly reduced. In addition, delays and wasted energy associated with "warm-up" times are also typically greatly reduced.

The many features and advantages of the invention are apparent from the detailed specification, and thus, it is intended by the appended claims to cover all such features and advantages of the invention which fall within the true spirits and cope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A separation device, comprising:

a centrifuge having system components comprising cooling fans, a drive motor and a refrigeration compressor and drive motor power electronics;

a controller that activates and/or deactivates a sleep mode of the system components, wherein said controller maintains operation of all said system components at a low energized state when the sleep mode is enabled and at full power when the sleep mode is deactivated;

a computer system; and a computer touch screen coupled to said computer system having a sleep mode function which allows the centrifuge to be placed in a dormant sleep condition wherein when a choice sleep now is selected on the touch screen with a choice scheduled sleep disabled, the centrifuge will immediately go into sleep mode and will remain sleeping until it is manually awakened, when the choice sleep now is selected on the touch screen with the choice scheduled sleep enabled, the centrifuge will immediately go to sleep until it automatically awakens at a specified time of day or until it is manually awakened before the specified time of day, and when the choice scheduled sleep is enabled and the choice sleep now has not been selected, the centrifuge will automatically go to sleep at a specified time of day and will remain sleeping until it automatically awakens at a second specified time or until it is manually awakened before the second specified time.

2. The device of claim 1, wherein said computer system is operated by a software protocol.

3. The device of claim 1, further comprising:

the computer touch screen coupled to said computer system, said screen implementing said software protocol to enable and/or disable said sleep mode.

4. The device of claim 1, wherein the controller is tiltably adjustable with respect to the centrifuge to accommodate various operators.

5. The device of claim 1, wherein test information may be input into the computer touch screen by manual input.

6. The device of claim 5, wherein said test information comprises the run time of the centrifuge.

7. The device of claim 6, wherein said test information comprises the temperature of the centrifuge.

8. A separation system, comprising:

a centrifuge having system components that includes cooling fans, a drive motor, a refrigeration compressor and drive motor power electronics;

means for controlling activation and/or deactivation of a sleep mode of the system components, wherein the controlling means maintains operation of the system components at a low power when the sleep mode is activated and at full power when the sleep mode is deactivated;

a touch screen means for operating the means for controlling activation and/or deactivation of a sleep mode wherein when a choice sleep now is selected on the touch screen means with a choice scheduled sleep disabled, the centrifuge will immediately go into sleep mode and will remain sleeping until it is manually awakened, when the choice sleep now is selected on the touch screen means with the choice scheduled sleep enabled, the centrifuge will immediately go to sleep until it automatically awakens at a specified time of day or until it is manually awakened before the specified time of day, and when the choice scheduled sleep is enabled on the touch screen means and the choice sleep now has not been selected, the centrifuge will automatically go to sleep at a specified time of day and will remain sleeping until it automatically awakens at a second specified time or until it is manually awakened before the second specified time.

9. The system of claim 8, wherein said means for controlling comprises:

a computer system operated by software protocol to manage the sleep mode.

10. The system of claim 8, further comprising:

means for interfacing with said means for controlling.

11. The system of claim 10, wherein said means for interfacing comprises:

a computer touch screen.

12. The separation system of claim 8, further comprised of said controlling means disabling the system components while remaining energized at a lower energy state when in the sleep mode.

13. A method of regulating power consumption in a separation device having system components that includes a refrigerator compressor, cooling fans, a drive motor and drive motor power electronics, the method comprising:

regulating the power consumption of said system components by coupling a computer system to said system components; and using a computer touch screen to enable and disable a sleep mode of the centrifuge to regulate the power consumption of said system components, wherein said controller maintains operation of said system components at a lower power level during said sleep mode and at full power when the sleep mode is deactivated with an energy saver mode function of the touch screen that allows the sleep mode to either occur immediately or at a specified time and allows the centrifuge to either be awakened manually or be awakened automatically at a specified time according to a combination of a selection or enablement of more than one screen icon.

14. The method of claim 13, wherein the regulating step is operated by the computer touch screen having a computer hardware system operated by a software protocol.

15. The method of claim 13, where the activating step includes operating a user interface of said computer touch screen.

16. The method of claim 13, further comprising:

programming the computer touch screen to permit said software protocol to enable and/or disable the sleep mode of the centrifuge.

17. The method of claim 13, wherein: the energy saver mode function operates such that when a choice sleep now is selected on the touch screen with a choice scheduled sleep disabled, the centrifuge will immediately go into sleep mode and will remain sleeping until it is manually awakened, when the choice sleep now is selected on the touch screen with the choice scheduled sleep enabled, the centrifuge will immediately go to sleep until it automatically awakens at a specified time of day or until it is manually awakened before the specified time of day, and when the choice scheduled sleep is enabled and the choice sleep now has not been selected, the centrifuge will automatically go to sleep at a specified time of day and will remain sleeping until it automatically awakens at a second specified time or until it is manually, awakened before the second specified time.

* * * * *